US005629119A

United States Patent [19]

Inoue et al.

[11] Patent Number: 5,629,119

[45] Date of Patent: May 13, 1997

[54] MAGNETIC CARRIER FOR ELECTROPHOTOGRAPHIC DEVELOPING AGENT

[75] Inventors: Toyotsune Inoue; Naruo Yabe; Hiroshi Shimoyama; Takuya Kadota; Toshiro Okae, all of Osaka, Japan

[73] Assignee: Mita Industrial Co., Ltd., Osaka, Japan

[21] Appl. No.: 534,881

[22] Filed: Sep. 27, 1995

[30] Foreign Application Priority Data

Sep. 28, 1994 [JP] Japan ..... 6-233668

[51] Int. Cl.[6] ..... G03G 9/107

[52] U.S. Cl. ..... 430/106.6; 430/108; 430/125

[58] Field of Search ..... 430/106.6, 108, 430/110, 125

[56] References Cited

U.S. PATENT DOCUMENTS 4,111,823 9/1978 Kobayashi et al. ..... 430/111

5,110,703 5/1992 Nagatsuka et al. ..... 430/106.6

5,494,768 2/1996 Boswell et al. ..... 430/106.6

OTHER PUBLICATIONS

Database WPI, Week 9008, Derwent Publications Ltd., AN 90–053453.

Abstract of Japanese Laid–Open Patent Publ. No. 2–002579 (Jan. 8, 1990); Patent Abstracts of Japan, vol. 14, No. 136 (P–1021).

*Primary Examiner*—Christopher D. Rodee

*Attorney, Agent, or Firm*—Sherman and Shalloway

[57] ABSTRACT

A two-component binder-type magnetic carrier for developing agent comprising a magnetic powder and a binder resin. The carrier particles contain dispersed therein a release agent of the type of a metal soap and have abrasive or collapsible surfaces. By using the developing agent which contains this carrier, the magnetic powder peels off the carrier particle surfaces maintaining a controlled particle diameter and amount. Therefore, the carrier particles possess fresh surfaces at all times, whereby the occurrence of spent toner is effectively prevented and the charging amount of the toner is stably maintained.

6 Claims, 1 Drawing Sheet

MAGNETIC CARRIER FOR ELECTROPHOTOGRAPHIC DEVELOPING AGENT

BACKGROUND OF THE INVENTION

1. Field of the Invention

The present invention relates to a magnetic carrier for an electrophotographic developing agent. More specifically, the invention relates to a magnetic carrier for an electrophotographic developing agent which is free from carrier trail, exhibits stable charging property of the toner, and makes it possible to form image of high density and high quality for extended periods of time.

2. Description of the Prior Art

In forming image by the electrophotographic method, two-component magnetic developing agents consisting of a toner and a magnetic carrier have been extensively used. The magnetic carriers can be roughly divided into two kinds, i.e., magnetic particle carriers such as iron powder and sintered ferrite particles, and so-called binder carriers obtained by granulating the magnetic powder together with a binder resin.

Japanese Laid-Open Patent Publication No. 324456/1992 discloses a carrier for a two-component developing agent consisting of at least a binder resin and a magnetic powder, the content of the magnetic powder being from 85 to 99% by weight of the weight of the binder resin, and the carrier gradually collapsing at the time of developing under the load of not larger than 100 g/cm$^2$ This carrier gradually collapses in the developing device and is consumed together with the toner. Therefore, the toner concentration in the developing agent is maintained constant at all times, and the device can be realized in a small size since there is no need of controlling the toner concentration in the developing agent.

In the above-mentioned prior art, the carrier-collapsing property is imparted by adjusting the content of magnetic powder in the carrier to lower the collapsing load. However, the carrier does not necessarily collapse uniformly, and sizes of the particles formed by the collapse undergo variation to a considerable degree, and the carrier adheres onto the non-image portions and fogging develops on the background of the image to deteriorate picture quality.

On the other hand, the two-component developing agent has a problem in regard to the occurrence of a so-called spent toner by which toner particles which are a resin composition containing a charge control agent gradually migrate like a film onto the surfaces of the carrier particles. When such a filming develops, the electric charge of the toner loses stability resulting in the occurrence of such problems as a decrease in the image density and fogging.

In an amorphous silicon (a-Si) photosensitive material, furthermore, the surfaces are attacked by discharge products such as ozone and the like produced by the corona charging, whereby oxides are formed rendering the surfaces to become hydrophilic and developing such defects as image flow and the like. To prevent such defects, a polishing agent has heretofore been contained in the developing agent.

In the binder-type magnetic carrier used for the two-component developing agent, if the magnetic powder can be peeled off the surfaces of the carrier maintaining controlled diameter and amount, fresh surfaces can be exposed on the surfaces of the carrier particles, and the charging property does not become unstable due to toner filming. In the case of the amorphous silicon photosensitive material, furthermore, it can be expected that the particles peeled off the surfaces of the carrier polish the oxide layer on the surface of the photosensitive material.

SUMMARY OF THE INVENTION

The object of the present invention therefore is to provide a carrier for a two-component developing agent which permits the magnetic powder to be peeled off the surfaces of the binder-type magnetic carrier maintaining controlled particle diameters and amounts, enabling fresh surfaces to be exposed on the surfaces of the carrier particles even after the carrier is used for extended periods of time.

Another object of the present invention is to provide a carrier for a two-component developing agent which permits the magnetic powder to be peeled off the surfaces of the binder-type magnetic carrier maintaining controlled particle diameters and amounts, making it possible to effectively polish the surface oxide layer which is a cause of image flow on the surface of the amorphous silicon photosensitive material.

According to the present invention, there is provided a binder-type magnetic carrier for electrophotographic developing agent comprising binder resin particles that contain a magnetic powder, wherein in said resin particles are dispersed the magnetic powder as well as a release agent that has both a polar group and a nonpolar group, and said resin particles have abrasive or collapsible surfaces.

The above-mentioned carrier is particularly useful as a developing agent for the electrophotographic method which uses an amorphous silicon drum and a cleaning blade.

A variety of release agents having a polar group and a nonpolar group can be used in the present invention as will be described later. From the standpoint of effects, however, a metal soap is particularly useful.

It is desired that the composition that is used contains the magnetic powder in an amount of 200 to 1000 parts by weight and, particularly, 300 to 500 parts by weight, and contains the release agent in an amount of 1 to 10 parts by weight and, particularly, 2 to 4 parts by weight per 100 parts by weight of the binder resin.

The degree of abrasive or collapsing property of the surfaces of the magnetic carrier particles (binder resin particles) can be found by filling a pot mill having a diameter of 60 mm (a volume of 300 cc) with 30 g of the magnetic carrier and 50 metal balls (stainless steel) having a diameter of 10 mm, and measuring the change in the particle diameter and particle size distribution after the ball-mill treatment at 200 rpm for two hours. According to the present invention, it is desired that the degree of abrasive or grinding property is such that the particle diameter (median diameter) after the ball-mill treatment is from 20 to 90% and, particularly, from 40 to 80% of the particle diameter (median diameter) of before the treatment, and the volume-based frequency of fine powder having particle diameters of not larger than 20 μm is from 3 to 30% and, particularly, from 10 to 20% of the whole amount.

DETAILED DESCRIPTION OF THE INVENTION

The magnetic carrier used in the present invention comprises at least a magnetic powder and a binder resin for binding the magnetic powder particles and further contains a release agent such as a metal soap having both a polar group and a nonpolar group, so that the magnetic powder is gradually peeled off the surfaces of the magnetic carrier particles and that the particle diameter and the amount of the magnetic powder that is peeled off are so controlled as will not lose charging property due to carrier trail and spent toner.

The present inventors have discovered an interesting fact that the collapsing degree of the binder-type magnetic carrier that is practically used for the developing agent is well corresponded to the behavior of particle size distribution of when the binder-type magnetic carrier is subjected to the ball-mill treatment.

Figure 1:
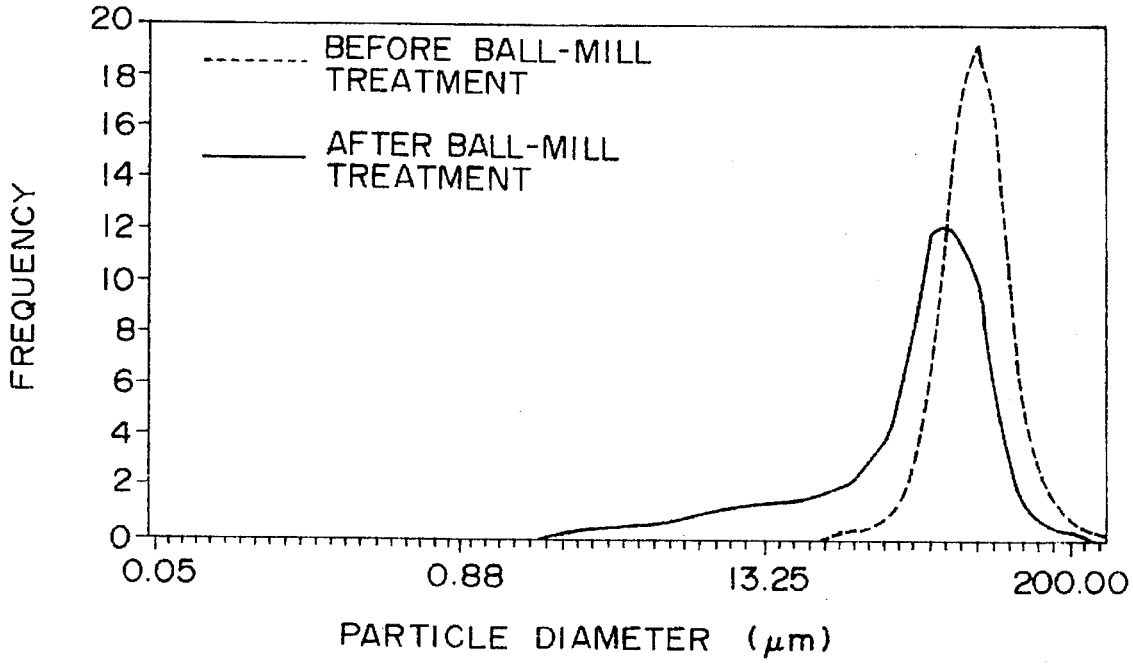
FIG. 1 is a curve of particle size distribution of a binder-type magnetic carrier blended with a metal soap of when it is subjected to the ball-mill treatment.
Figure 2:
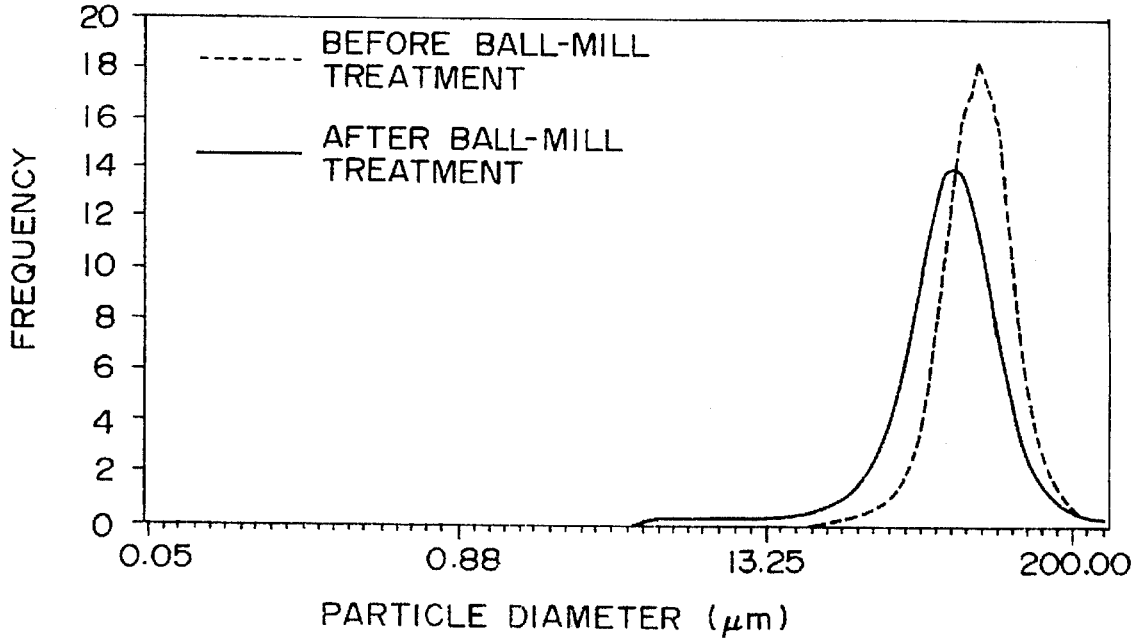
FIG. 2 is a curve of particle size distribution of a magnetic carrier which is the same as that of FIG. 1 but without blended with metal soap of when it is subjected to the ball-mill treatment.

The accompanying FIG. 1 shows a curve of particle size distribution of a binder-type magnetic carrier (for details, refer to Example 1 appearing later) blended with a metal soap of when it is subjected to the ball-mill treatment, and FIG. 2 is a curve of particle size distribution of a binder-type magnetic carrier prepared in the same manner as that of FIG. 1 but without blended with metal soap of when it is subjected to the ball-mill treatment. In FIGS. 1 and 2, broken curves represent particle size distributions of before being subjected to the ball-mill treatment.

It will be obvious from these results that in these binder-type magnetic carriers, the particle diameter (median particle diameter) after the ball-mill treatment is shifting toward the side of a small diameter compared with that of before the ball-mill treatment. Here, however, the magnetic carrier blended with the metal soap has a particle diameter (median diameter) which is shifted more to the side of small diameters and has a very larger content of a fine powder of particle diameters of not larger than 20 μm than those of the magnetic carrier which is not blended with metal soap. That is, it will be understood that the binder-type magnetic carrier is subject to be easily ground when it is blended with a metal soap.

Reference should be made to Comparative Example 1 and Example 1 in Table 1 appearing later. That is, when the binder-type magnetic carrier exhibiting collapsing tendency of FIG. 2 is used for the two-component developing agent to effect developing, the blow-off charging amount of the toner of the developing agent drops to −4.9 μc/g after the running of 100,000 pieces of copies, the image density drops to 1.011 and the fogging density increases to 0.014. When the same number of pieces of copies are taken by using the binder-type magnetic carrier that exhibits the collapsing tendency shown in FIG. 1, the blow-off charging amount of the toner is maintained at a level which is as high as −10.2 μc/g without at all developing carrier trail, the image density is maintained at a level as high as 1.397, and the fogging density is suppressed to a level as low as 0.003. This means that in the binder-type magnetic carrier of the present invention, the magnetic powder is gradually peeled off the surfaces of the magnetic carrier without causing the magnetic carrier to be cracked, and fresh surfaces are exposed without permitting the charging property to be deteriorated by the spent toner.

Reference should further be made to Comparative Example 2 and Example 2 that will be described later. When the carrier having collapsing tendency of FIG. 2 is used for the two-component developing agent to take 10,000 pieces of copies using the a-Si photosensitive material, there appears image flow tendency. When the carrier having collapsing tendency of FIG. 1 is used for the two-component developing agent to obtain copies, on the other hand, it will be obvious that the image flow does not develop even after 240,000 pieces of copies are obtained. That is, in the binder-type magnetic carrier of the present invention, it will be understood that the magnetic fine powder is supplied to between the a-Si photosensitive material and the cleaning blade to effectively grind a hydrophilic oxide layer or the like layer formed on the surface of the a-Si photosensitive material.

In general, particles are pulverized in two ways; i.e., volume pulverization and surface pulverization. In the former case, a particle splits into two or more. In the latter case, the surface only of the particle drops or peels off.

In the binder-type magnetic carrier of the present invention, the surface pulverization gradually proceeds within an effective range under practical developing conditions. The reason why the surface pulverization occurs has not yet been recognized to a sufficient degree when the magnetic binder particles are blended with a release agent such as a metal soap having a polar group and a nonpolar group. It is, however, considered that an easily collapsible interface is formed in which micelles of the release agent such as metal soap are finely distributed in the form of thin layers in the particles, and fine particles are peeled off the surfaces thereof. This is quite contrary to the widely accepted idea that the metal soap assists the dispersion of powder in the resin to reinforce the binding force.

In the present invention, it is desired that the magnetic powder and the release agent are blended in amounts within ranges as described above with respect the binder resin. When the blending amount of the magnetic powder is smaller than the above-mentioned range, the magnetic force of the carrier drops resulting in the occurrence of carrier trail and insufficient pulverization of the surfaces. When the amount of the magnetic powder exceeds the above-mentioned range, on the other hand, the volume pulverization takes place and the carrier loses the life.

When the blending amount of the release agent is smaller than the above-mentioned range, the surface pulverization of the magnetic carrier decreases giving disadvantage with respect to charging stability of the toner with the passage of time and image flow of the a-Si photosensitive material. When the blending amount of the release agent is greater than the above-mentioned range, on the other hand, the magnetic carrier loses particle strength and heat resistance.

According to the present invention, excellent results are obtained in maintaining printing resistance in the practical developing when the abrasive or collapsing property on the surface of the magnetic carrier gives the above-mentioned particle size distribution through the ball-mill treatment.

[Magnetic carrier]

The binder-type carrier of the present invention comprises at least a magnetic powder and a binder resin, the carrier particles containing, dispersed therein, a release agent that has a polar group and a nonpolar group and further having abrasive or collapsible surfaces.

In the magnetic carrier for electrophotographic developing agent, the release agent having a polar group and a nonpolar group dispersed in the matrix of a magnetic powder and a binder resin, works to offer abrasive or collapsible surfaces to the carrier.

The release agent having a polar group and a nonpolar group forms an easily peeling interface between the resins in the carrier or in a matrix of resin and magnetic powder. Any solid release agent having a polar group and a nonpolar group can be used. The polar group stands in an ordinary meaning. Examples include so-called anionic group, cationic group and nonionic group. The nonpolar group, on the other hand, opposes the polar group. Examples include oleophilic group or hydrophobic group such as long-chain aliphatic group, alicyclic group, aromatic aliphatic group, and aliphatic aromatic group. The release agent offers a peeling interface and, particularly, a peeling interface when the developing agent is being used.

The most representative example of the release agent having both the polar group and the nonpolar group include a higher fatty acid and derivatives thereof, a polyolefin wax modified with a polar group, a variety of solid or semi-solid surfactants such as anionic, cationic or nonionic surfactant.

Examples of the higher fatty acid include saturated fatty acid with 12 to 30 carbon atoms and, particularly, with 16 to 18 carbon atoms, and, particularly, a stearic acid, palmitic acid, lauric acid, fatty acid of tallow oil, fatty acid of coconut oil, fatty acid of palm oil and a mixture fatty acid such as fatty acid of hydrogenated vegetable oil. Among them, stearic acid is preferred.

Examples of the derivative of the higher fatty acid include a metal salt of a higher fatty acid and, particularly, metal salts, amides and esters.

The metal salt exhibits excellent properties in regard to imparting a suitable degree of abrasive property to the carrier and moisture resistance to the carrier, and its examples include a calcium salt, a magnesium salt, a barium salt, a strontium salt and a zinc salt of a fatty acid such as stearic acid, palmitic acid and lauric acid. Among them, a magnesium salt of a higher fatty acid is particularly preferred.

As the higher fatty acid amide, there can be exemplified stearoamide, ethylenebisstearoamide, erucic amide, and N,N'-bishydroxyethyl lauramide.

As the ester, there can be exemplified an ethylene oxide adduct of a polyhydric alcohol ester of a higher fatty acid, sorbitan fatty acid ester and polyethylene glycol fatty acid ester.

There can be further preferably used waxes graft-modified with an ethylenically unsaturated carboxylic acid or an anhydride thereof and, particularly, acid-modified olefin resin wax such as maleic anhydride-modified polypropylene wax, maleic anhydride-modified polyethylene wax and acrylic acid-modified polyethylene wax.

It is desired that the release agent containing the polar group and the nonpolar group is used in an amount of from 1 to 10 parts by weight and, particularly, from 2 to 5 parts by weight per 100 parts by weight of the binder resin. When the amount is smaller than the above-mentioned range, it becomes difficult to form abrasive or collapsible surfaces. When the amount is greater than the above-mentioned range, on the other hand, the developing agent tends to form blocks.

As the magnetic powder for the magnetic carrier of the present invention, there can be used any magnetic powder that has heretofore been used for the binder-type carrier, such as tri-iron tetroxide ($Fe_3O_4$), iron sesquioxide ($\gamma$-$Fe_2O_3$), zinc ion oxide ($ZnFe_2O_4$), yttrium iron oxide ($Y_3Fe_5O_{12}$), cadmium iron oxide ($CdFe_2O_4$), gadolinium iron oxide ($Gd_3Fe_5O_{12}$), copper iron oxide ($CuFe_2O_4$), lead iron oxide ($PbFe_{12}O_{19}$), nickel iron oxide ($NiFe_2O_4$), neodium iron oxide ($NdFeO_3$), barium iron oxide ($BaFe_{12}O_{19}$), magnesium iron oxide ($MgFe_2O_4$), manganese iron oxide ($MnFe_2O_4$), lanthanum iron oxide ($LaFeO_3$), iron powder (Fe), cobalt powder (Co), nickel powder (Ni), etc.

The magnetic powder which is particularly adapted to the object of the present invention is a fine particulate tri-iron tetroxide (magnetite). The preferred magnetite has an ortho-octahedral shape with a particle diameter of from 0.05 to 1.0 μm. The magnetite particles may be treated on their surfaces with a silane coupling agent or a titanium coupling agent.

It is desired that the magnetic powder is used in an amount of from 200 to 1000 parts by weight and, particularly, from 300 to 500 parts by weight per 100 parts by weight of the binder resin. When the amount is smaller than the above-mentioned range, the magnetic attractive force of the binder-type carrier decreases and the carrier tends to be scattered. When the amount is larger than the above-mentioned range, on the other hand, the carrier loses mechanical strength.

As the binder resin, there can be used a thermoplastic resin or a thermosetting resin which is uncured or is in the form of an initial condensation product. Examples include a vinyl aromatic resin such as polystyrene, or an acrylic resin, polyvinyl acetal resin, polyester resin, epoxy resin, phenol resin, petroleum resin and polyolefin resin. Among them, styrene resin, acrylic resin or styrene/acrylic copolymer resin is preferably used.

It is desired that the binder-type carrier of the present invention has a particle diameter of from 50 to 200 μm and, particularly, from 80 to 100 μm. The carrier particles may have any shape such as amorphous shape, spherical shape or amorphous shape with rounded corners.

As described earlier, the degree of abrasive property or collapsing property of the magnetic carrier is such that the particle diameter (median diameter) after the ball-mill treatment is from 20 to 90% of the particle diameter (median diameter) of before being ball-mill treated and that the volume-based frequency (amount of formation) of fine powder having particle diameters of not larger than 20 μm is from 3 to 30% and, particularly, from 10 to 20% of the whole amount.

The abrasive or collapsing property is given to the binder-type carrier by changing the kind of the release agent that has a polar group and a nonpolar group, amount of blend and the conditions for kneading the blended composition. For instance, a relationship is found in advance between at least one of the above-mentioned conditions and the amount of formation of fine powder through the ball-mill treatment, and the conditions are so set that the fine powder is formed in a desired amount.

The magnetic carrier for electrophotographic developing agent of the present invention can be prepared by blending the above-mentioned components in compliance with any widely known method such as pulverization /classification method, melt granulation method, spray granulation method or polymerization method. Here, however, the pulverization/classification method is particularly preferred.

The above-mentioned components of the binder-type carrier are pre-mixed (dry-mixed) in a mixer such as Henschel's mixer, kneaded together using a kneading device such as a biaxial extruder, and the kneaded composition is cooled, pulverized and is classified to obtain a carrier. The carrier components are kneaded to form an easily collapsible interface in which micelles of the parting agent such as metal soap are finely. distributed in the form of thin layers in the kneaded composition. Though it may vary depending upon the melting point of the binder resin, etc., it is desired that the kneading is generally effected at a temperature which is higher than the melting point (Tm) of the binder resin and the melting point of the parting agent, i.e., at a temperature of about Tm+10° C. to Tm+100° C. for about 0.5 to 5 minutes. Moreover, the pulverization and classification must be such that the carrier having the above-mentioned particle diameters is obtained.

[Use]

The magnetic carrier of the present invention is used as a two-component developing agent being mixed with a toner that has been known per se. The toner is obtained by dispersing a coloring agent and, as required, a charge control agent in a fixing resin, followed by granulation into amorphous or spherical particles having a particle diameter of from 5 to 20 μm.

It is desired that the mixing ratio of the magnetic carrier and the toner is usually from 98:2 to 90:10 and, particularly, from 97:3 to 94:6 on the weight basis.

In the electrophotographic copying method using toner of the present invention, the electrostatic latent image can be formed by any method that has been widely known. For instance, the photoconducting layer on the electrically conducting substrate is uniformly charged and is exposed to light bearing image to form electrostatic latent image.

The electrostatic latent image is easily developed by bringing the magnetic brush of the two-component magnetic developing agent into contact with the photosensitive material. The toner image formed by developing is transferred onto a copying paper. The toner image is then brought into contact with a heating roll to fix it. After the toner image is transferred, the toner remaining on the photosensitive material is removed by being slid with a blade and is used again in the above-mentioned step.

By using the two-component developing agent containing the magnetic carrier of the present invention, the carrier surfaces are worn out and maintained fresh at all times even when the resin composition containing the charge control agent gradually migrates from the toner particles onto the surfaces of the carrier particles. Accordingly, the electric charge of the toner remains stable, and there occurs no such problem as drop in the image density or fogging.

The magnetic carrier of the present invention is particularly effective as a two-component developing agent for the amorphous silicon (a-Si) photosensitive material. In the amorphous silicon (a-Si) photosensitive material, furthermore, the surfaces are attacked by discharge products such as ozone and the like produced by the corona charging, whereby oxides are formed rendering the surfaces to become hydrophilic and developing such defects as image flow and the like. According to the present invention, however, the magnetic powder emitted from the magnetic carrier due to abrasion works as a polishing agent which effectively prevents the occurrence of image flow. Effects are exhibited particularly distinctly in a system which uses the cleaning blade.

EXAMPLES

The invention will now be described by way of working examples.

Example 1

| | |
|---|---|
| Styrene acrylic resin (m.p. 143° C., produced by Sekisui Kagaku Kogyo Co.) | 100 parts by weight, |
| Magnetite (produced by Titan Kogyo Co.) | 400 parts by weight, |
| Carbon black (produced by Deggusa Co.) | 5 parts by weight, |
| Magnesium stearate | 3 parts by weight, |

were mixed together using a Henschel's mixer, melt-kneaded using a biaxial kneader set at a melt-kneading temperature of 170° C., and were pulverized and classified to prepare a carrier having an average particle diameter of 82 μm.

Comparative Example 1

A carrier was prepared in the same manner as in the above-mentioned Example 1 but without adding magnesium stearate.

By using the carriers prepared in Example 1 and in Comparative Example 1 and the toner having an average particle diameter of 10 μm, developing agents were prepared having a carrier to toner ratio of 95:5 on the weight basis. By using a modified copying machine, Model DC2556 produced by Mita Kogyo Co. (organic photosensitive drum), 100,000 pieces of copies were continuously obtained to evaluate properties of the developing agents. The results were as shown in Tables 1 and 3.

The carriers were further subjected to the ball-mill treatment according to the method described in the specification. Particle size distributions before and after the treatment were as shown in FIGS. 1 and 2.

By using a modified copying machine, Model DC25585 produced by Mita Kogyo Co. (employing an amorphous silicon drum), copies were continuously obtained to evaluate properties of the developing agents. The results were as shown in Tables 2 and 3.

Example 2

A carrier was prepared in the same manneras in Example 1 but adding magnetite in an amount of 100 parts by weight.

Example 3

A carrier was prepared in the same manner as in Example 1 but adding magnetite in an amount of 1100 parts by weight.

Example 4

A carrier was prepared in the same manner as in Example 1 but adding magnesium stearate in an amount of 0.5 parts by weight.

Example 5

A carrier was prepared in the same manner as in Example 1 but adding magnesium stearate in an amount of 11 parts by weight.

By using carriers of Examples 2 to 5 and the above-mentioned amorphous silicon drum, experiment was conducted in the same manner as in Example 1 or 2 to evaluate their properties. The results were as shown in Table 3.

TABLE 1

(organic photosensitive drum)

| | Example 1 | Comparative Example 1 |
|---|---|---|
| First | | |
| ID | 1.359 | 1.391 |
| FD | 0.002 | 0.002 |
| Amount of charge | −10.2 μC/g | −10.1 μC/g |
| After the running of 100,000 pieces | | |
| ID | 1.397 | 1.011 |
| FD | 0.003 | 0.014 |
| Amount of charge | −10.2 μC/g | −4.9 μC/g |

TABLE 2

| | (amorphous silicon drum) | |
|---|---|---|
| | Example 1 | Comparative Example 1 |
| Initial image flow | no | no |
| Image flow after 10,000 pieces of running | no | yes |
| Image flow after 240,000 pieces of running | no | — |

TABLE 3

| | Example* | | | | | |
|---|---|---|---|---|---|---|
| | 1a | 1b | 2 | 3 | 4 | 5 |
| Carrier trail (number) | 0.3 | 0.3 | 2.0 | 0.3 | 0.4 | 0.4 |
| Strength (%) | 75 | 75 | 90 | 40 | 80 | 70 |
| Image flow after 240,000 pieces of running | — | no | no | no | no | no |
| Charge stability after 100,000 pieces of running | 100 | 100 | 90 | 95 | 75 | 100 |

Note: In Example 1a, the organic photosensitive drum was used, and in other examples the amorphous silicon drum was used.

In Table 3, the properties were evaluated in compliance with the methods and on the bases as described below.

Carrier trail: Eighteen mesh images are formed each being a square having a side of 25 mm and forming a lattice maintaining a gap of 0.5 mm, and the number of black dots developed in the mesh images are counted. The carrier trail is evaluated on the basis of the number of black dots in each mesh image.

Strength: A pot mill having a volume of 300 cc is filled with 30 g of a magnetic carrier and 50 stainless steel balls having a diameter of 10 mm to execute the ball-mill treatment at 200 rpm for two hours. The strength is evaluated in terms of a ratio (%) of the particle diameter of the magnetic carrier after the treatment to the particle diameter of before the treatment.

Image flow: Blurring in the copied image is judged by naked eyes.

Charge stability: The charge stability is evaluated in terms of a ratio (%) of the charging amount of the toner after 100,000 pieces of copies are obtained to the initial charging amount.

We claim:

1. A magnetic carrier for a magnetic developing agent comprising:

binder resin particles in which a magnetic powder is dispersed in an amount of 200 to 1000 parts by weight per 100 parts by weight of the binder resin, wherein in said resin particles is dispersed a metal salt of a higher fatty acid, said higher fatty acid having 12 to 30 carbon atoms, said metal salt being present in an amount of 2 to 5 parts by weight per 100 parts by weight of the binder resin, and said resin particles having abrasive surfaces.

2. A magnetic carrier according to claim 1, wherein the metal salt is a magnesium salt.

3. A magnetic carrier according to claim 2, wherein the metal salt is magnesium stearate.

4. A magnetic carrier according to claim 1, wherein said binder resin particles, which have a magnetic powder dispersed therein and a metal salt of a higher fatty acid dispersed therein, have a volume-based average particle diameter of from 50 to 200 μm.

5. A magnetic carrier according to claim 4, wherein said binder resin particles, which have a magnetic powder dispersed therein and a metal salt of a higher fatty acid dispersed therein, have such abrasive surfaces that when a pot mill having a diameter of 60 mm and a volume of 300 cc is filled with 30 g of the magnetic carrier and 50 stainless steel balls having a diameter of 10 mm to effect the ball-mill treatment at a rotational speed of 200 rpm for two hours, the median particle diameter after the treatment is from 20 to 90% of the median particle diameter before the treatment, and the volume-based frequency of fine powder having a particle diameter of not larger than 20 μm is from 3 to 30% of the whole amount.

6. An electrophotographic method comprising:

developing an electrostatic latent image formed on an amorphous silicon photosensitive material by a two-component magnetic developing agent which contains a toner and a magnetic carrier to form a toner image on said photosensitive material;

transferring at least a part of said toner image to a copying paper; and removing toner remaining on said photosensitive material by a blade;

wherein said magnetic carrier comprises:

binder resin particles in which a magnetic powder is dispersed in an amount of 200 to 1000 parts by weight per 100 parts by weight of the binder resin, wherein in said resin particles is dispersed a metal salt of a higher fatty acid, said higher fatty acid having 12 to 30 carbon atoms, said metal salt being present in an amount of 2 to 5 parts by weight per 100 parts by weight of the binder resin, and said resin particles having abrasive surfaces.

* * * * *